US007934356B2

(12) United States Patent
Yuyama et al.

(10) Patent No.: US 7,934,356 B2
(45) Date of Patent: May 3, 2011

(54) MACHINE FOR FILLING BAG WITH MEDICINE

(75) Inventors: Shoji Yuyama, Toyonaka (JP); Takayuki Fujikawa, Toyonaka (JP); Hidenori Tsuji, Toyonaka (JP)

(73) Assignee: Yuyama Mfg. Co., Ltd., Osaka (JP)

( * ) Notice: Subject to any disclaimer, the term of this patent is extended or adjusted under 35 U.S.C. 154(b) by 44 days.

(21) Appl. No.: 12/293,271

(22) PCT Filed: Mar. 7, 2007

(86) PCT No.: PCT/JP2007/054446

§ 371 (c)(1),
(2), (4) Date: Sep. 16, 2008

(87) PCT Pub. No.: WO2007/108325

PCT Pub. Date: Sep. 27, 2007

(65) Prior Publication Data

US 2009/0084070 A1 Apr. 2, 2009

(30) Foreign Application Priority Data

Mar. 16, 2006 (JP) ..... 2006-073460

(51) Int. Cl.
*B65B 5/06* (2006.01)

(52) U.S. Cl. ..... 53/255; 53/570; 53/247; 53/250; 53/384.1; 53/284.7

(58) Field of Classification Search ..... 53/570–571, 53/247, 459, 249–251, 255, 260, 384.1, 386.1, 53/284.7, 329.3
See application file for complete search history.

(56) References Cited

U.S. PATENT DOCUMENTS 4,062,169 A * 12/1977 Lister et al. ..... 53/439
4,476,664 A * 10/1984 Kroll et al. ..... 53/258
4,706,440 A * 11/1987 Bittner ..... 53/438
5,195,303 A * 3/1993 Tomanovits ..... 53/459
(Continued)

FOREIGN PATENT DOCUMENTS

DE 19959408 A1 6/2001
(Continued)

OTHER PUBLICATIONS

International Search Report for PCT/JP2007/054446 (4 pages, in English and Japanese).

(Continued)

*Primary Examiner* — Christopher R. Harmon
(74) *Attorney, Agent, or Firm* — Jones Day; Christopher C. Bolten

(57) ABSTRACT

To quickly fill a bag with medicine containers without damaging the containers, a machine for filling a bag with medicine containers includes: a bag positioning member (4) for positioning and opening a bag (13); a first moving member (37) that reciprocates between a supply position inside the bag (13) and a waiting position outside the bag (13), the first moving member including a bottom surface portion for supporting medicine containers; a second moving member that reciprocates relative to the bag (13) and includes a guide surface (47) guiding medicine containers (11) to the bottom surface portion; and a drive-control means (59) that moves the first moving member (37) from the supply position to the waiting position while maintaining the second moving member (38) in a fixed position relative to the bag (13), thereby causing medicine containers (11) guided by the guide surface (47) to the bottom surface portion to remain in the bag (13).

12 Claims, 15 Drawing Sheets

U.S. PATENT DOCUMENTS

| | | | | | |
|---|---|---|---|---|---|
| 5,249,409 | A | * | 10/1993 | Jensen | 53/459 |
| 5,452,559 | A | * | 9/1995 | Lipes | 53/67 |
| 5,660,022 | A | * | 8/1997 | Lade et al. | 53/252 |
| 5,685,129 | A | * | 11/1997 | Baker | 53/469 |
| 6,024,221 | A | * | 2/2000 | Yuyama et al. | 206/528 |
| 6,094,895 | A | * | 8/2000 | Ravizza | 53/567 |
| 6,351,926 | B1 | * | 3/2002 | Hodge et al. | 53/473 |
| 6,691,490 | B1 | | 2/2004 | Yuyama et al. | |

FOREIGN PATENT DOCUMENTS

| | | | |
|---|---|---|---|
| JP | 04-128101 | A | 4/1992 |
| JP | 08-072813 | A | 3/1996 |
| JP | 2000-079908 | A | 3/2000 |
| JP | 2000-085707 | A | 3/2000 |
| JP | 2004-148033 | A | 5/2004 |
| JP | 2005-153903 | A | 6/2005 |
| WO | WO 2004/080809 | | 9/2004 |

OTHER PUBLICATIONS

Written Opinion for PCT/JP2007/054446 (3 pages, in Japanese).

Extended Search Report for EP 07737960.0-2308, Mailed Jun. 4, 2010, 5 pages.

* cited by examiner (a)

(b)

MACHINE FOR FILLING BAG WITH MEDICINE

CROSS REFERENCE TO RELATED APPLICATIONS

This application is a 35 U.S.C. §371 U.S. National Stage filing of International Application No. PCT/JP2007/054446, filed Mar. 7, 2007, the entire contents of which are incorporated by reference herein, which claims priority under 35 U.S.C. §119 to Japanese Patent Application No. 2006-073460, filed Mar. 16, 2006, the entire contents of which are incorporated by reference herein.

TECHNICAL FIELD

The present invention relates to a machine for filling a bag with medicine in containers liable to suffer damage, such as ampoules.

BACKGROUND ART

In a conventionally well-known machine for filling a bag with medicine containers, medicine containers conveyed by a second belt conveyor are conveyed to a first belt conveyor while being gathered by a guide member, and are temporarily stopped by a shutter member before being charged into a bag (see, for example, Patent Document 1).

In another well-known machine for filling a bag with medicine containers, medicine containers conveyed by a belt conveyor are temporarily stopped by a shutter member while being gathered by a guide member, and are conveyed to a conveyor unit extending into a bag before retracting the conveyor unit from the bag, thereby charging the medicine containers into the bag (see, for example, Patent Document 2).

Patent Document 1: JP 2004-148033 A

Patent Document 2: JP 2005-153903 A

SUMMARY OF THE INVENTION

In both of the above-mentioned machines for filling a bag with medicine containers, medicine containers are gathered by a guide member, making it necessary to slowly convey the medicine containers with the belt conveyor so as not to damage them. Accordingly, it is impossible to charge medicine containers into the bag at high speed. Further, the medicine containers are conveyed by belt conveyors respectively provided at two positions, and it is necessary to provide each of the belt conveyors with a drive means such as a motor. This results in a rather complicated structure, which leads to an increase in cost.

It is accordingly an object of the present invention to provide a machine for filling a bag with medicine containers, which can quickly fill a bag with medicine containers without involving a fear of the medicine containers being damaged.

As a means for solving the above-mentioned problem, the present invention provides a machine for filling a bag with containers that includes: a bag positioning member for positioning and opening a bag; a first moving member that reciprocates between a supply position inside the bag and a waiting position outside the bag, the first moving member including a bottom surface portion for supporting medicine containers; a second moving member that reciprocates relative to the bag and includes a guide surface for guiding medicine containers to the bottom surface portion; and a drive-control means that moves the first moving member from the supply position to the waiting position while maintaining the second moving member in a fixed position relative to the bag, thereby causing medicine containers on the bottom surface portion to remain in the bag.

With this construction, when the medicine containers are on the bottom surface portion of the first moving member, the first moving member and the second moving member are positioned in the bag, and solely the first moving member is retracted from the bag, the medicine containers remain inside the bag by virtue of the guide surface. The first moving member and the second moving member are solely reciprocated relative to the bag. Thus, the drive mechanism is simple and relatively free from failure, and can be operated quickly. Further, it is possible to supply medicine containers into the bag solely by controlling the positional relationship of the two moving members with respect to the bag. Then, the medicine containers supplied into the bag together with the two moving members maintain their positional relationships with the bag. Thus, even when there are a plurality of medicine containers, there is no need to greatly change the positional relationship of the medicine containers, and it is possible to move the two moving members and the bag at high speed relative to each other. Thus, the medicine containers are not easily damaged, and can be quickly charged into the bag.

It is preferable that the machine for filling a bag with medicine containers further includes a shutter member that is positionable at an outflow preventing position to prevent outflow of medicine containers placed on the bottom surface portion of the first moving member, and is further positionable at a medicine container supply position where supply of medicine containers to the bottom surface portion is allowed and where an opening portion inner edge of the bag is pressed.

With this construction, the medicine containers supplied to the bottom surface of the first moving member via the guide surface of the second moving member can be temporarily stored by means of the shutter member. When supplying the medicine containers into the bag, it is possible to press the inner edge of the opening of the bag with the shutter member, and hence it is possible to secure the supply route for the medicine containers. Thus, the medicine containers can be smoothly supplied into the bag.

It is preferable that the second moving member include a detachment preventing portion that prevents detachment of the medicine containers from the guide surface to an exterior of the bag when the drive-control means moves the first moving member from the supply position to the waiting position.

With this construction, the supply of medicine containers to the bottom surface of the first moving member can be effected smoothly via the guide surface of the second moving member; when the medicine containers are to remain in the bag, it is possible to reliably prevent detachment of the medicine containers from the bag using the detachment preventing portion. Thus, the first moving member can be moved at relatively high speed, making it possible to perform the operation of filling a bag with medicine containers at still higher speed.

It is preferable that the second moving member include a climbing suppressing portion that comes into contact with the medicine containers to suppress climbing of the medicine containers onto the guide surface when the drive-control means moves the first moving member from the supply position to the waiting position.

With this construction, when the medicine containers are to remain in the bag, it is also possible to suppress climbing of medicine containers onto the guide surface using the climbing suppressing portion, and hence the movement of the medicine containers is minimized, enhancing the prevention of damage. Further, since the medicine containers scarcely ever climb onto the guide surface, it is possible to conduct the operation of filling a bag with medicine containers at still higher speed.

It is preferable that the machine for filling a bag with medicine containers further includes a cover member that covers an upper portion of a medicine container supply region formed by the first moving member and the second moving member, in which the cover member includes a medicine container charging port that allows supply of medicine containers onto the bottom surface portion via the guide surface when the first moving member is in the waiting position, and that prevents medicine containers from being guided onto the bottom surface portion and prevents the medicine containers from escaping from the bag when the first moving member is in the supply position.

With this construction, no new medicine containers can be charged through the charging port, and medicine containers supplied through the charging port are incapable of escaping from the charging port, when the first moving member is moved to the supply position. Thus, even if the first moving member is moved at high speed for causing the medicine containers supplied to the supply region to remain in the bag, it is possible to reliably prevent outward detachment.

It is preferable that the bag positioning member include a bag temporary sealing portion for temporarily sealing an opening of the bag so that the medicine containers therein become temporarily incapable of removal from the bag.

With this construction, even when the bag containing medicine containers is transferred to some other place, it is possible to prevent removal of the medicine containers from the bag during or after the transfer. When it becomes necessary to extract the medicine containers from the bag for inspection or the like, the medicine containers can be easily extracted from the bag solely by canceling the temporary sealing.

Further, as a means for solving the above-mentioned problem, the present invention provides a machine for filling a bag with medicine containers including: a bag positioning member for positioning and opening a bag; a belt conveyor that horizontally reciprocates between a supply position inside the bag and a waiting position outside the bag, the belt conveyor being drivable to supply medicine containers placed thereon into the bag; a medicine container charging member for supplying medicine containers onto the belt conveyor; and a drive-control means that horizontally moves the belt conveyor to the waiting position, drives the medicine container charging member to supply medicine containers onto the belt conveyor, moves the belt conveyor to the supply position inside the bag, and drives the belt conveyor to supply medicine containers placed thereon into the bag.

It is preferable that the bag positioning member include, in addition to the above-mentioned construction, a bag temporary sealing portion for temporarily sealing an opening of the bag so that medicine containers therein may become temporarily incapable of removal from the bag.

Still further, as a means for solving the above-mentioned problem, the present invention provides a machine for filling a bag with medicine containers, the machine including: a bag positioning member for positioning and opening a bag; a belt conveyor including a belt stretched between a pair of rotatable pulleys, the belt conveyor reciprocating between a supply position inside the bag and a waiting position outside the bag; a medicine container charging member for charging medicine containers onto the belt conveyor; a guide member for guiding medicine containers charged by the medicine container charging member onto the belt conveyor; and a drive-control means that horizontally moves the belt conveyor to the waiting position, drives the medicine container charging member to supply medicine containers onto the belt conveyor via the guide member, and, after moving the belt conveyor and the guide member to the supply position bag, retracts solely the belt conveyor out of the bag to prevent movement of the medicine containers by the guide member, thereby causing medicine containers to remain in the bag.

According to the present invention, it is only necessary to reciprocate the first moving member and the second moving member relative to the bag, and hence the machine is simplified in construction, and can be produced at low cost. Further, since the medicine containers are caused to remain in the bag by retracting the first moving member from the bag, the medicine containers do not move much and are not easily damaged, and the bag filling operation can be conducted at high speed.

BRIEF DESCRIPTION OF THE DRAWINGS

FIG. 10(*b*) is a plan view showing a state in which solely the outer container is retracted from part (a).

DESCRIPTION OF REFERENCE NUMERALS

1 . . . machine main body,
2 . . . bag printing portion,
3 . . . bag conveying portion,
4 . . . bag positioning portion,
5 . . . medicine container supply portion,
6 . . . medicine container charging portion,
7 . . . bag printer,
8 . . . bag roll,
9 . . . strip-like bag,
10 . . . cutter,
11 . . . medicine containers,
12 . . . host computer,

13 . . . bag,
14 . . . horizontal moving member,
15 . . . vertical moving member,
16 . . . suction member,
17 . . . horizontal frame member,
18 . . . support arm,
19 . . . body portion,
20 . . . suction portion,
21 . . . suction cylinder,
22 . . . conveyor portion,
23 . . . rotation plate,
24 . . . bag opening portion,
25 . . . bag temporary sealing portion,
26 . . . bag retaining arm,
27 . . . bucket,
28 . . . guide groove,
29 . . . elongated hole,
30 . . . ascent/descent member,
31 . . . support frame,
32 . . . presser member,
33 . . . guide portion,
34 . . . arm portion,
35 . . . connecting portion,
36 . . . pressing portion,
37 . . . outer container (first moving member),
38 . . . ampoule extruding member (second moving member),
39 . . . shutter member,
40 . . . cover member,
41 . . . support member,
42 . . . slide shaft,
43 . . . frame,
44 . . . nut portion,
45 . . . ball screw,
47 . . . guide surface,
48 . . . detachment preventing portion,
49 . . . climbing suppressing portion,
50 . . . tray,
51 . . . driven gear,
52 . . . intermediate gear,
53 . . . driving gear,
54 . . . charging port,
55 . . . lifter,
56 . . . swinging arm,
57 . . . guide rail,
58 . . . slider,
59 . . . control device (drive control means),
100 . . . belt conveyor,
101 . . . pulley,
102 . . . belt,
110 . . . ridge,
111 . . . first inclined surface,
112 . . . second inclined surface,
113 . . . third inclined surface,
115 . . . inclined surface,
120 . . . belt conveyor,
121 . . . guide wall,
122 . . . pulley, and
123 . . . belt.

DETAILED DESCRIPTION

In the following, an embodiment of the present invention is described with reference to the accompanying drawings.

Figure 1:
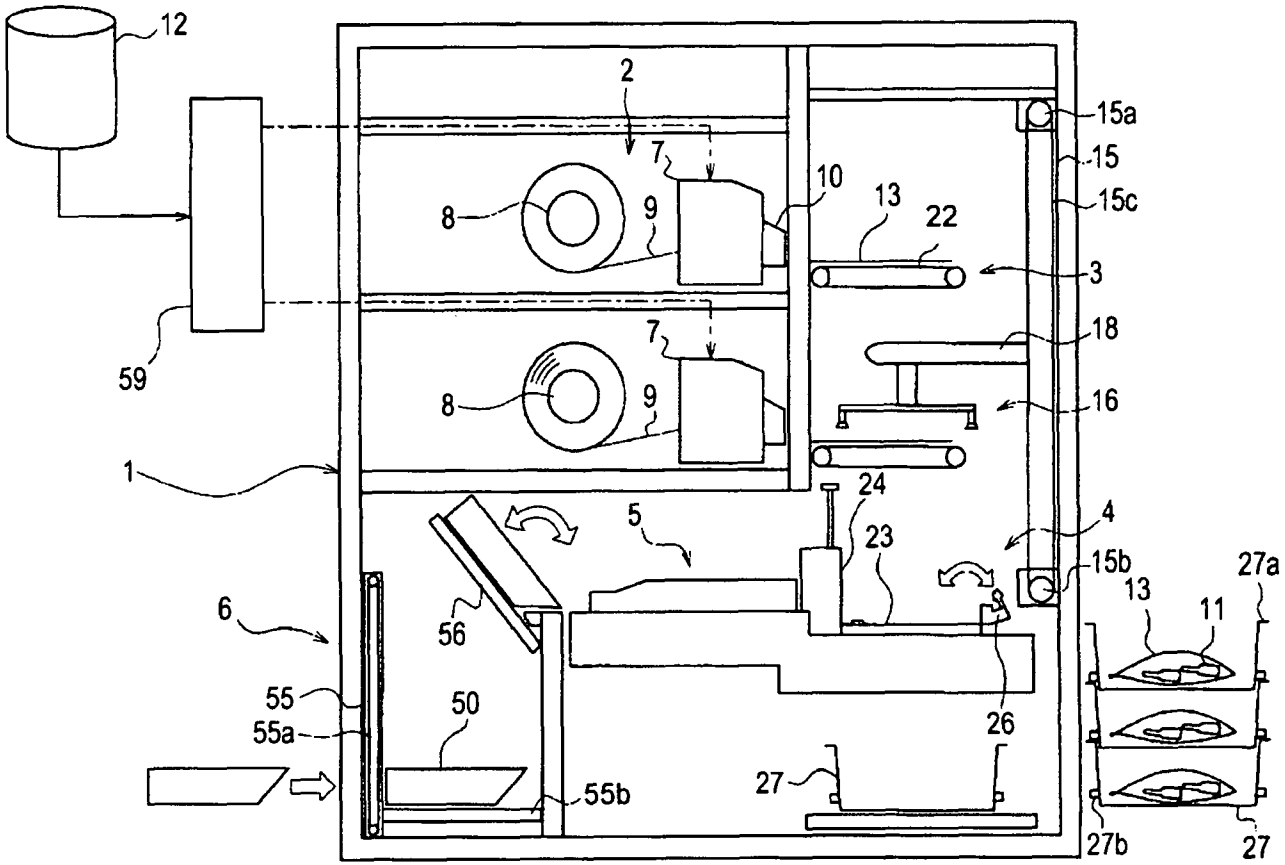
FIG. 1 illustrates a schematic front view of a machine for filling a bag with medicine containers according to an embodiment.
Figure 2:
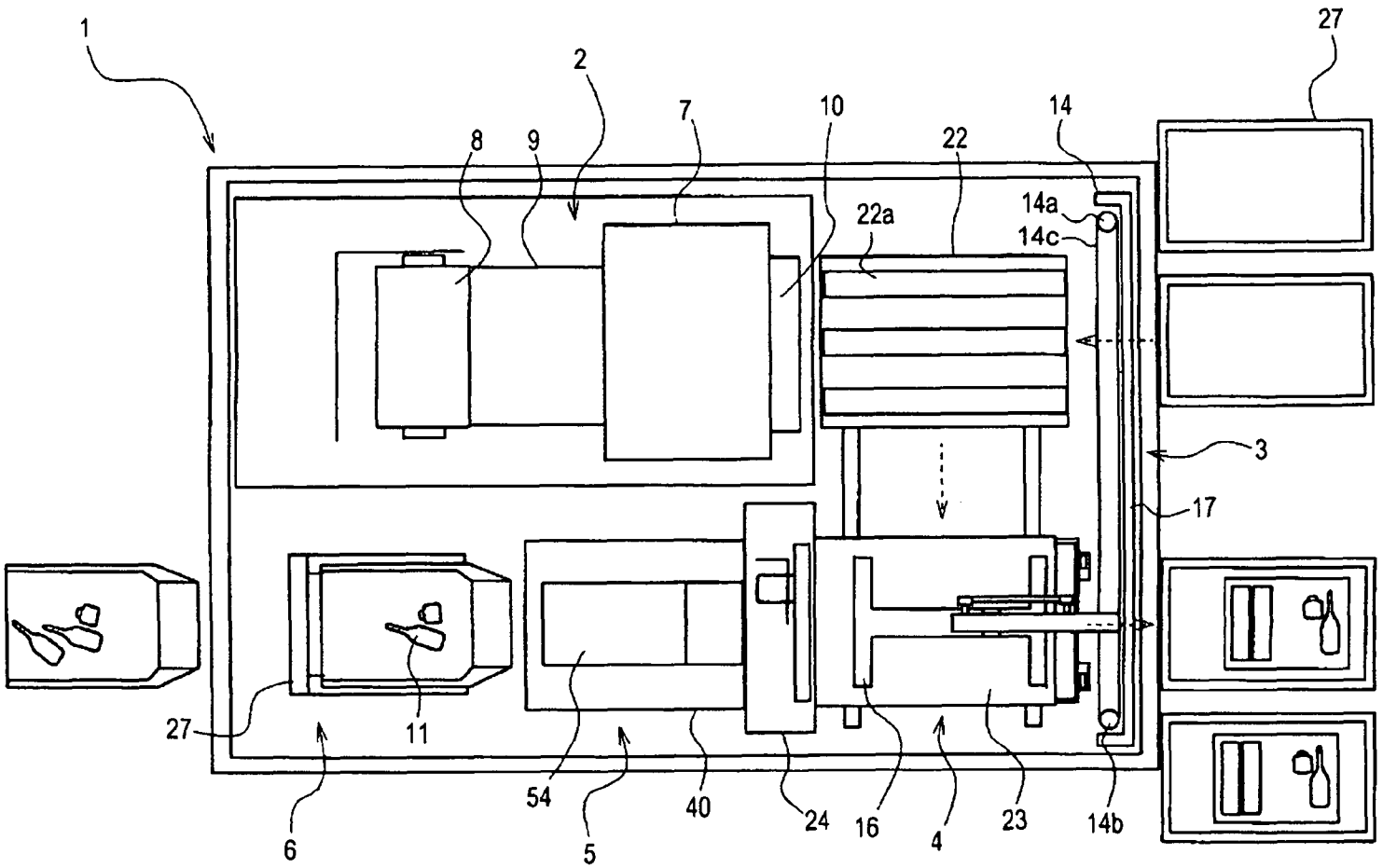
FIG. 2 illustrates a plan view of the machine of FIG. 1.

(General Construction) FIGS. 1 and 2 schematically show a machine for filling a bag with medicine containers according to one embodiment. This machine for filling a bag with medicine containers includes a machine main body 1, which includes a bag printing portion 2, a bag conveying portion 3, a bag positioning portion 4, a medicine container supply portion 5, and a medicine container charging portion 6.

(Bag Printing Portion) The bag printing portion 2 includes upper and lower bag printers 7. Strip-like bags 9 are successively supplied to each bag printer 7 from respective bag rolls 8. The strip-like bags 9 include a plurality of successive bags, each previously formed into a bag open in a direction opposite to the conveying direction. The strip-like bags 9 are cut into individual bags 13 by a cutter 10 provided at the outlet portion of the bag printing portion 2. The strip-like bags 9 are formed of a translucent material, allowing medicine containers 11 accommodated therein to be visually checked. Affixed to the surfaces of the strip-like bags 9 are a plurality of labels for printing. Each bag printer 7 prints the patient name, the name of the medicine, information on taking the medicine (use, dosage, etc.), and the like, on each label based on prescription data or the like input from a host computer 12. Individual bags 13, obtained by cutting the strip-like bags 9 with the cutter 10, are supplied to a conveyor portion 22. The conveyor portion 22 includes three belts 22*a* that can be driven in synchronism with each other. The bags 13 are transferred to a predetermined position before undergoing positioning, as described in greater detail below.

(Bag Conveying Portion) As shown in FIGS. 1 and 2, the bag conveying portion 3 includes a horizontal moving member 14, a vertical moving member 15, and a suction member 16.

The horizontal moving member 14 includes a belt 14*c* stretched between pulleys 14*a*, 14*b*, which are respectively arranged on the right-hand and left-hand sides of the machine main body 1. The entire horizontal moving member 14 is retained by a horizontal frame member 17. When one pulley 14*a* is driven by a motor or the like (not shown) to rotate in normal/reverse rotating direction, the belt makes normal/reverse circulation movement, and the horizontal moving member 14 reciprocates in the X-axis direction.

The vertical moving member 15 includes a belt 15*c* stretched between pulleys 15*a*, 15*b*, which are respectively arranged on the upper and lower sides of the machine main body 1. Vertical moving member 15 is substantially of the same construction as the horizontal moving member 14 except that it instead vertically reciprocates. It should be noted, however, that the horizontal frame member 17 is fixed to the belt 14*c* of the horizontal moving member 14, and that the whole reciprocates in the vertical direction (Z-direction) as the vertical moving member 15 is driven.

Figure 4:
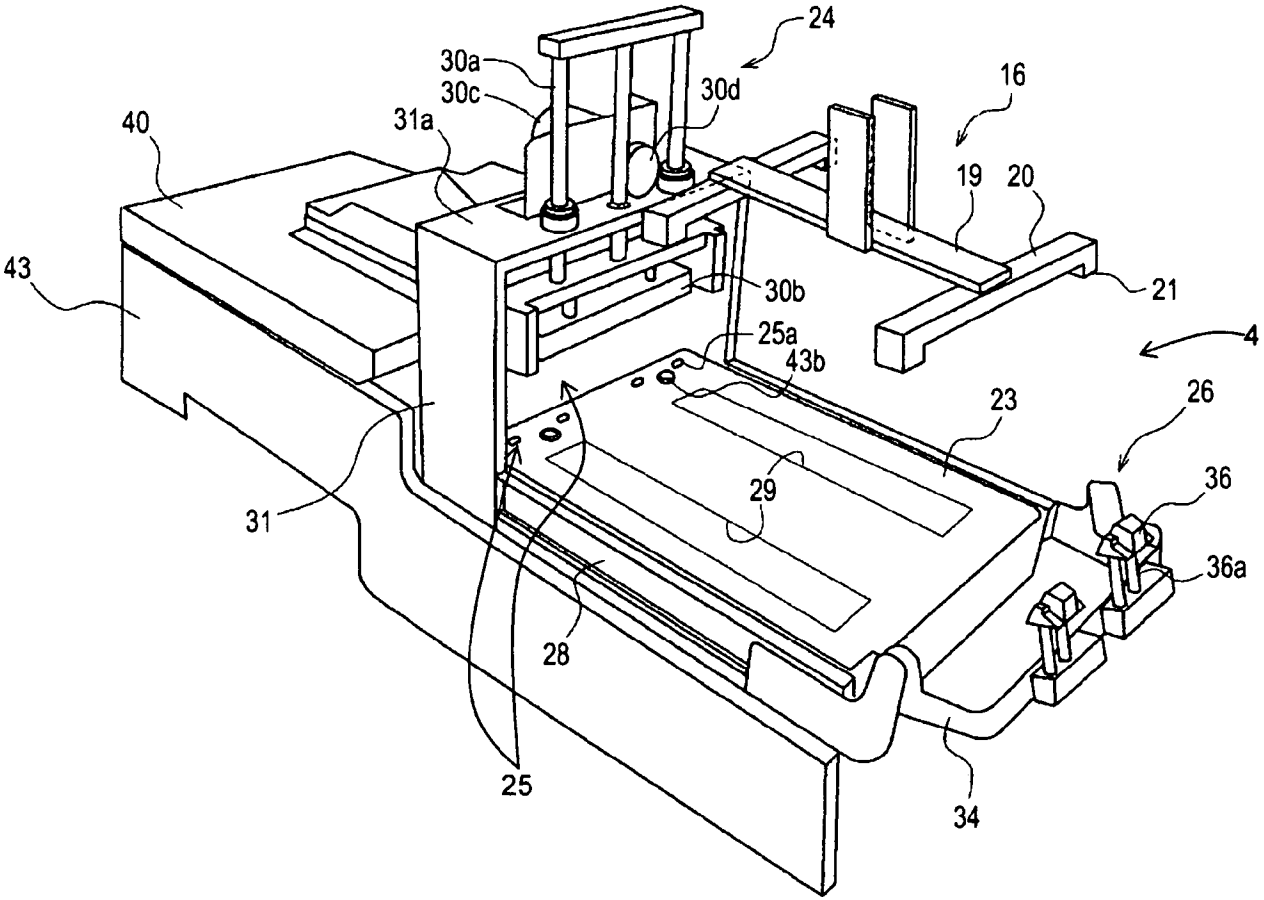
FIG. 4 illustrates a perspective view of the medicine container supply portion of FIG. 3 as seen from a different angle.

The suction member 16 is mounted to the belt 15*c* of the vertical moving member 15 via a support arm 18. As illustrated in FIG. 4, suction member 16 has a substantially I-shaped configuration, and includes a body portion 19 extending along the support arm 18 and suction portions 20 having end portions extending in orthogonal directions. The body portion 19 is hollow, and is connected to a suction device (not shown) allowing the four corners of the bag 13 to be suctioned and thus retained with suction cylinders 21, which downwardly extend from the distal ends of each suction portion 20. Further, as described above, the suction member 16 is reciprocated in the longitudinal direction (Y-axis direction) with respect to the support arm 18 by a longitudinal moving member including pulleys and a belt.

(Bag Positioning Portion) As shown in FIG. 4, the bag positioning portion 4 includes a rotation plate 23, a bag opening portion 24, a bag temporary sealing portion 25 (see FIG. 8), and a bag retaining arm 26.

Figure 5:
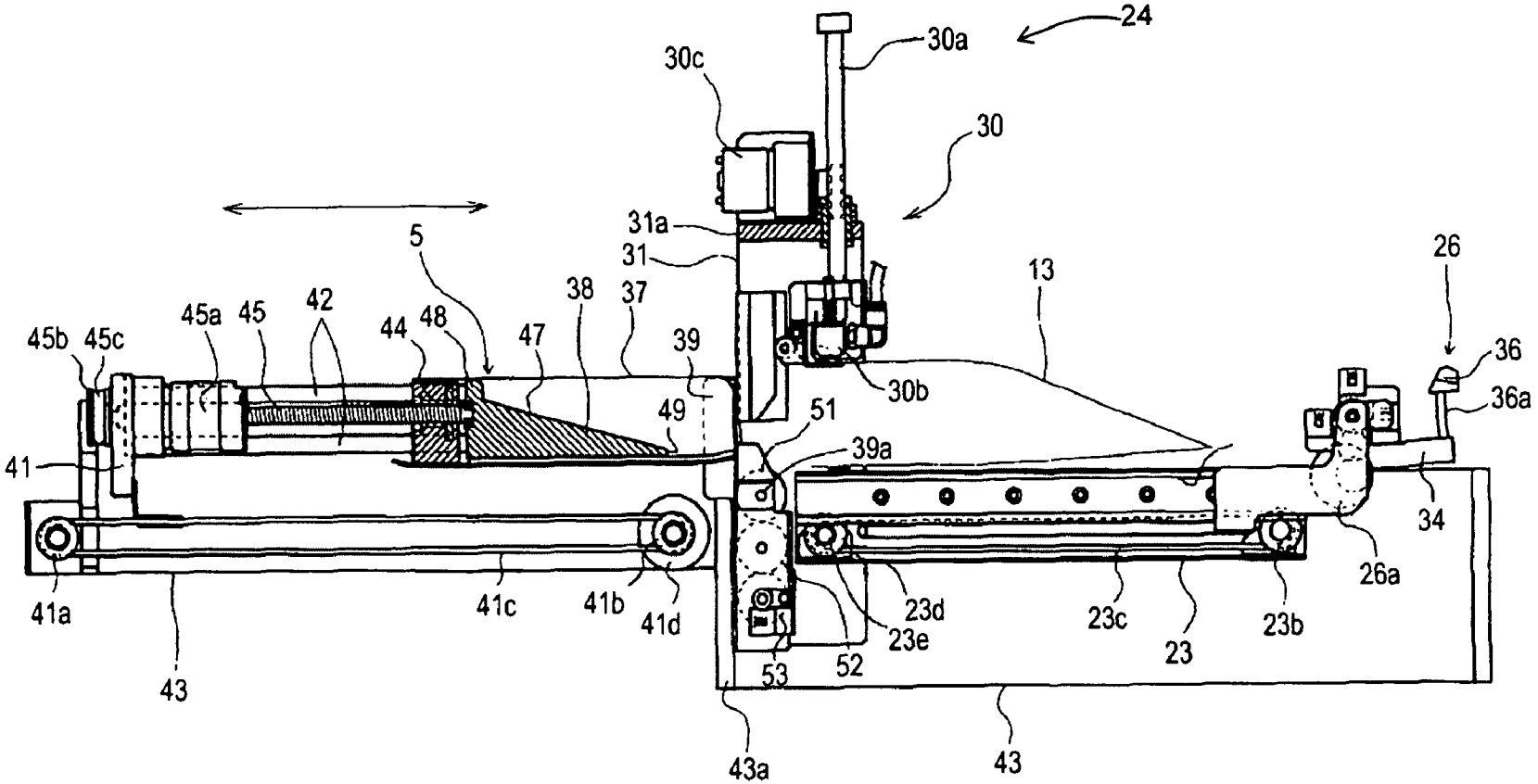
FIG. 5 illustrates a front view of the medicine container supply portion of the machine shown in FIG. 1.
Figure 6:
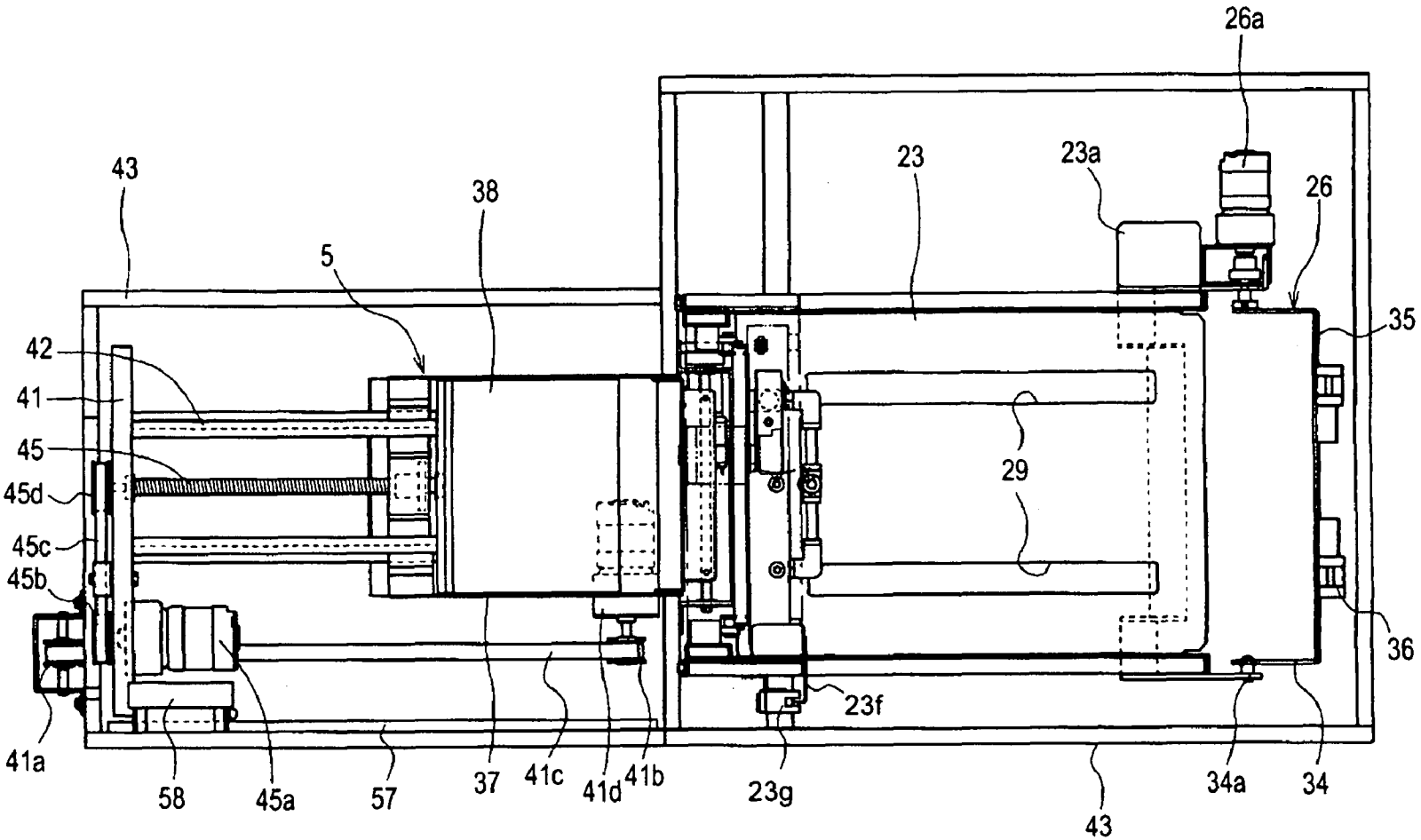
FIG. 6 illustrates a plan view of the medicine container supply portion of the machine shown in FIG. 1 (waiting position).

As shown in FIGS. 5 and 6, the rotation plate 23 is rotated through driving of a motor 23*a* around a support shaft 23*e* via pulleys 23*b*, 23*d* and a belt 23*c*, and can be set in a horizontal position and an inclined position in which the distal end thereof is directed obliquely downwards. The rotating position of the rotation plate 23 is judged based on whether or not a shield plate 23*f* provided at a shaft portion intercepts the light path of a sensor 23*g* (light emitting element and light receiving element) provided in the machine main body 1. In the horizontal position, the rotation plate 23 allows charging of medicine containers 11 into the bag 13 placed on the top surface thereof, and allows, in the inclined position, the bag 13 to be supplied to a bucket 27 (see FIG. 1). As illustrated in FIG. 4, guide grooves 28 are formed in both side surfaces of the rotation plate 23, and two elongated holes 29 are formed therein to extend along both side portions.

Figure 7:
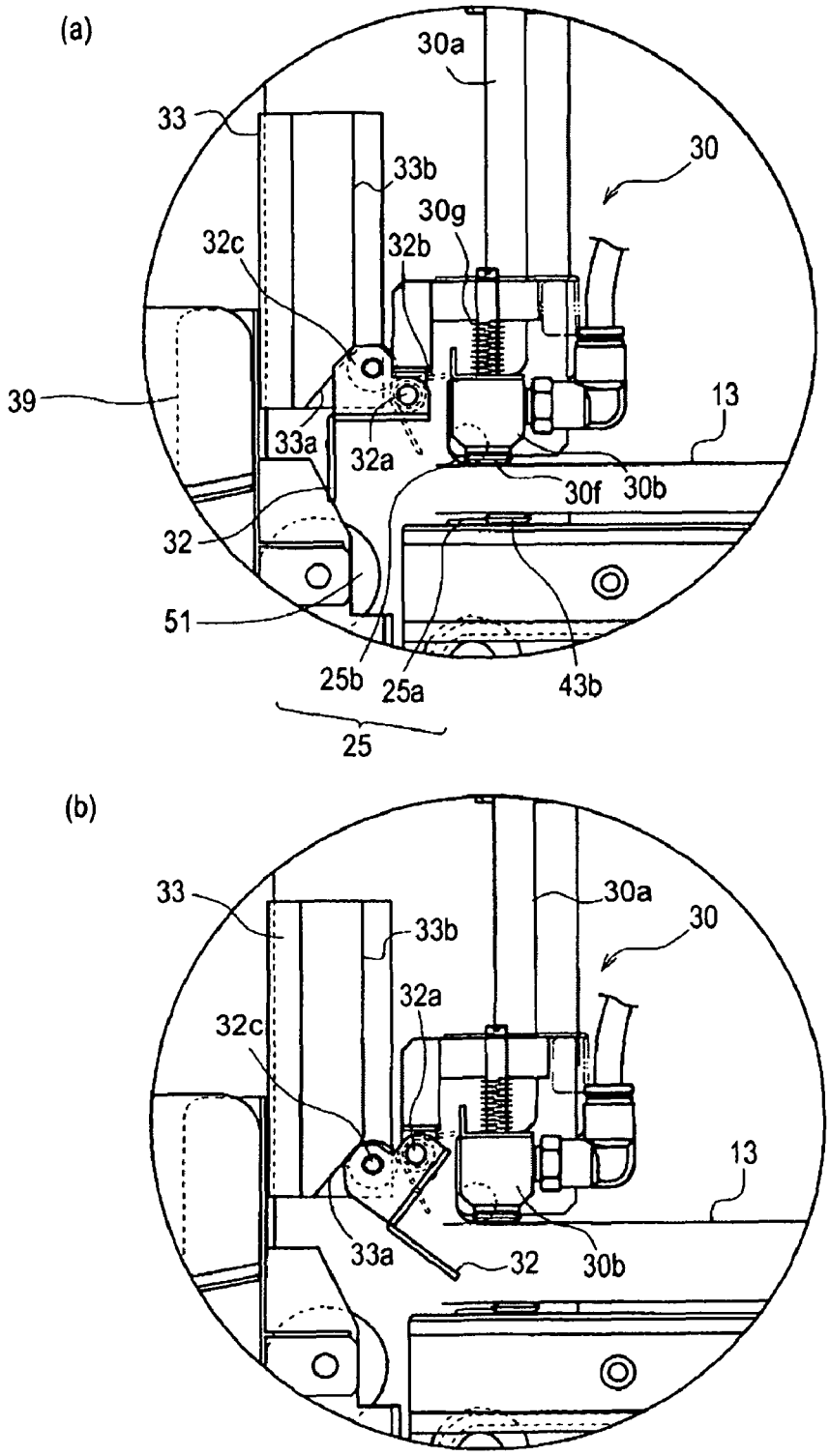
FIGS. 7(*a*)-7(*b*) illustrates a front view showing in detail the motion of a region including an ascent/descent member.
Figure 8:
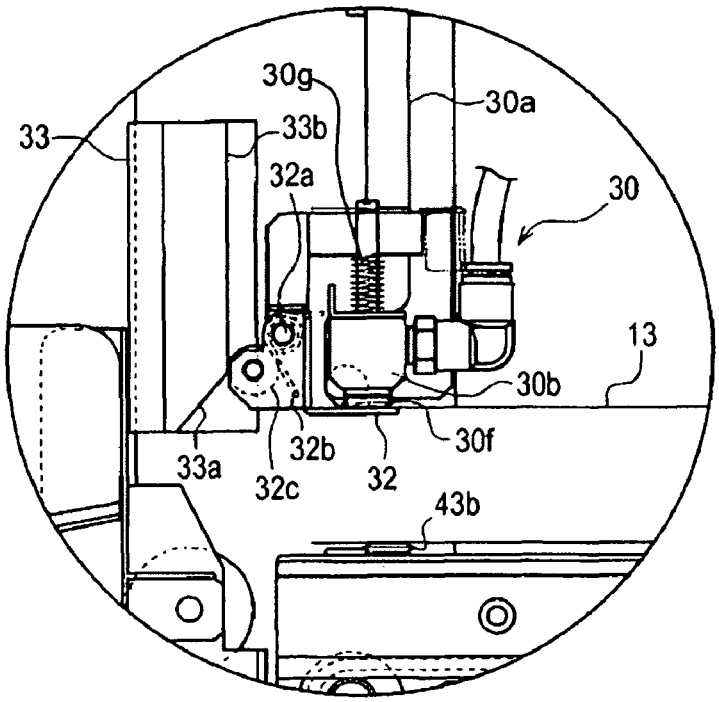
FIG. 8(*a*)-8(*b*) illustrates a front view showing in detail the motion of a region including the ascent/descent member.
Figure 8:
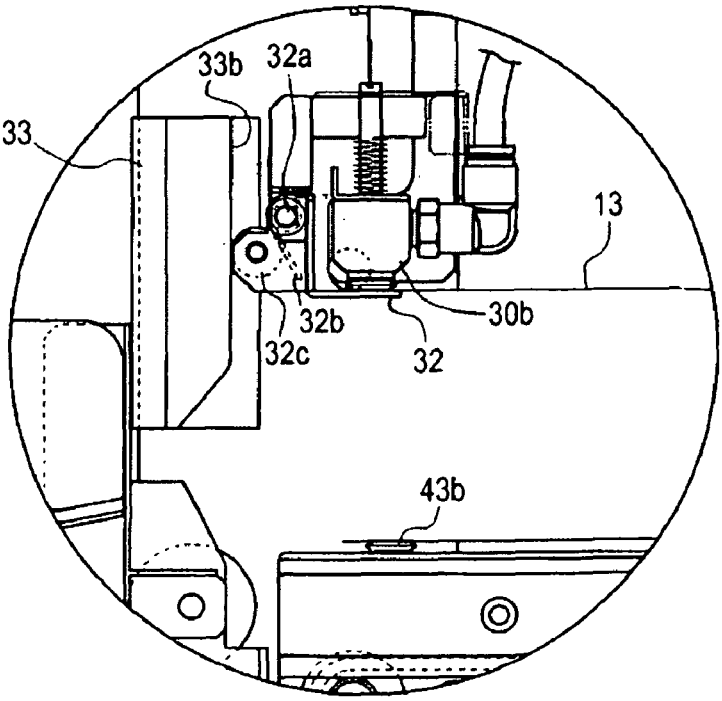

As shown in FIGS. 5, 7(*a*)-7(*b*), and 8(*a*)-8(*b*), the bag opening portion 24 includes an ascent/descent member 30. The ascent/descent member 30 is provided in a gate-shaped support frame 31 fixed to a frame 43 (support portion 43*a* of rotation plate 23) so as to be capable of ascending and descending. The ascent/descent member 30 includes an ascent/descent plate 30*b* urged downwardly by a spring 30*g*. Further, the ascent/descent member 30 includes three rods 30*a* extending through an arch portion 31*a* of the support frame 31. Of the three rods 30*a*, the one situated at the center has a gear portion (not shown), which is in mesh with a gear 30*d* (see FIG. 4) provided on the rotation shaft of a motor 30*c*. As a result, when the motor 30*c* is rotated, the ascent/descent plate 30*b* ascends or descends via the rods 30*a*. The support portion 43*a* of the rotation plate 23 and the ascent/descent member 30 have at both ends suction ports 43*b* and 30*f*. The suction ports 43*b* and 30*f* are connected to a suction device (not shown) via a communication hole (not shown), and suction and retain from the outer side the opening portion of the bag 13, which is placed on the rotation plate 23 in the horizontal position. When the ascent/descent member 30 is raised in this suction/retention state, the opening portion of the bag 13 is opened. Further, the arch portion 31*a* of the support frame 31 supports a presser member 32 of a substantially L-shaped configuration so as to allow rotation around a support shaft 32*a* between an opening position and a retaining position. The presser member 32 is urged toward the opening position by a spring 32*b* fitted onto the support shaft 32*a*. Further, the presser member 32 includes a roller 32*c* which rolls on an inclined surface 33*a* and a vertical surface 33*b* of a guide portion 33 provided in the support frame 31. As a result, when the ascent/descent member 30 is raised, the roller 32*c* rolls on the inclined surface 33*a*, and the presser member 32 rotates counterclockwise around the support shaft 32*a* as shown in FIGS. 8(*a*)-8(*b*). When the roller 32*c* reaches the vertical surface 33*b*, the presser member 32 retains the upper inner surface of the opened bag 13.

As shown in FIG. 4, the bag temporary sealing portion 25 includes four heating portions 25*a* provided on the support portion of the rotation plate 23, and a roller 25*b* (see FIGS. 7(*a*)-7(*b*)) rotatably provided on the ascent/descent member 30 so as to be opposed to each heating portion 25*a*. With the bag 13 being positioned at a predetermined position on the rotation plate 23, the ascent/descent member 30 is lowered, and the opening portion of the bag 13 is held between the heating portions 25*a* and the roller 25*b* to effect heating by supplying electricity to the heating portions 25*a*. Then, the opening portion of the bag 13 is heat-sealed at four positions arranged at predetermined intervals in the width direction. In this case, the heat-sealed portions are arranged at such intervals as make it impossible or less liable for the medicine containers accommodated in the bag 13 to be spilled out thereof. The heat sealing is effected to the degree that when the opening portion is pulled to both sides so as to extract the medicine containers 11 from the bag 13, the heat-sealed portions are separated relatively easily, allowing the bag 13 to be opened.

As shown in FIGS. 4, 5, and 6, the bag retaining arm 26 includes arm portions 34 that reciprocate along the guide grooves 28 of the rotation plate 23 and rotate around a support shaft 34*a*, and a connecting portion 35 connecting the two arm portions 34. Pressing portions 36 are provided at the two end portions of the connecting portion 35 through the intermediation of elastic portions 36*a*. The pressing portions 36 are formed of a material, such as rubber, which exhibits a large coefficient of friction with respect to the bag 13. By driving the motor 26*a*, the bag retaining arm 26 is rotated around the support shaft 34*a*, and the pressing portion 36 is brought into contact with the bag 13 placed on the rotation plate 23. The elongated holes 29 of the rotation plate 23 are situated at the contact position of the pressing portion 36. Thus, when the rotation plate 23 is rotated to the inclined position, and the bag retaining arm 26 is caused to slide, with the pressing portion 36 being at the contact position, it is possible to effectively apply the frictional resistance due to the pressing portion 36 to the bag 13. As a result, the bag 13 moves smoothly and obliquely downwards on the rotation plate 23 to be naturally supplied to the bucket 27.

As shown in FIG. 1, each bucket 27 is formed as a box open on the top side and has an outwardly extending flange portion 27*a* at the upper opening edge thereof. Further, a ridge 27*b* is formed on the bottom side portion of the outer surface of each bucket 27. Thus, when the buckets 27 are stacked together, the flange portion 27*a* of each bucket supports the ridge 27*b* of the upper bucket 27, thereby forming an accommodation space. The buckets 27 are supplied from the outside of the machine main body 1, and are conveyed to a position below the rotation plate 23. After the bags 13 are accommodated therein, the buckets are conveyed to the exterior of the machine main body 1 to be stacked together.

(Medicine Container Supply Portion) As shown in FIGS. 4, 5, and 6, the medicine container supply portion 5 includes an outer container 37 serving as a first moving member, an ampoule extruding member 38 serving as a second moving member, a shutter member 39, and a cover member 40.

The outer container 37 is formed as a box that is open on the top and front sides, and is fixed to a support member 41 via four slide shafts 42. A buffer member formed of urethane, sponge or the like is attached to the bottom surface of the outer container 37 so that the supplied medicine containers 11 may not suffer damage. The frictional resistance of the surface of this buffer member is minimized so that the medicine containers 11 may easily slide when the outer container 37 moves as described below.

The support member 41 is fixed to a belt 41*c* stretched between pulleys 41*a*, 41*b*. The pulleys 41*a*, 41*b* are rotatably supported by the frame 43 of the machine main body 1. One pulley 41*b* is driven by a motor 41*d* to rotate in the normal or reverse direction. As a result, the outer container 37 reciprocates in the directions indicated by the arrows in FIG. 5, and is positioned at a waiting position shown in FIG. 5 and a supply position shown in FIGS. 10(*a*) and 11(*c*). Further, together with the outer container 37, a slider 58 reciprocates along a guide rail 57 provided on the frame 43. The slider 58 is provided for the purpose of effecting accurate positioning on the outer container 37 with respect to the frame 43. In an example of a specific construction for this purpose, a portion to be detected is provided to extend along the guide rail 57, and this portion to be detected is detected by a sensor provided on the slider.

At the rear of the outer container 37, there is provided a nut portion 44, which is threadedly engaged with a ball screw 45. The ball screw 45 is driven to rotate by the motor 45*a* via the pulleys 45*b*, 45*d*, and the belt 45*c*. Thus, when the motor 45*a* is driven to rotate the ball screw 45 in the normal or reverse direction, the position at which the nut portion 44 is threadedly engaged with the ball screw 45 is displaced in the axial direction. As a result, the outer container 37 reciprocates, and its positional relationship with the ampoule extruding member 38 described below varies. The upper edges of the forward ends of both side surfaces of the outer container 37 are formed in an arcuate configuration, thereby preventing damage of the bag 13 when medicine containers are inserted into the bag 13.

The ampoule extruding member 38 is formed of a synthetic resin material, and is accommodated in the outer container 37, thereby forming a medicine container storage region within the outer container 37. One end portion of the ball screw 45 is rotatably connected to the rear portion of the ampoule extruding member 38 through the intermediation of a bearing, and, at the same time, one end portion of each slide shaft 42 is connected thereto. As a result, the ampoule extruding member 38 reciprocates between the waiting position and the supply position together with the outer container 37. When, at the supply position, solely the outer container 37 is caused to retreat through rotation of the ball screw 45, it is possible to allow the medicine containers 11 in the medicine container storage region to remain in the bag 13.

As shown in FIG. 5, the ampoule extruding member 38 includes a guide surface 47, a detachment preventing portion 48, and a climbing suppressing portion 49.

The material, the surface roughness, and the inclination angle of the guide surface 47 are selected such that the medicine containers 11, supplied from a tray 50 (see FIG. 1) via a charging port 54 (see FIG. 3), can be smoothly supplied. While in this case the guide surface 47 is formed as a flat surface, it is also possible to adopt some other form, such as a convex surface arcuate in section or a concave surface arcuate in section. When the guide surface 47 is formed as a convex surface, the tangential direction of the arc of its section becomes closer to the vertical direction on the bottom surface side of the outer container 37, and hence it is possible to eliminate the climbing suppressing portion 49.

The detachment preventing portion 48 is formed by a ridge protruding upwardly from the upper edge portion of the guide surface 47. As described below, by causing the outer container 37 to retreat relative to the ampoule extruding member 38, it is possible to prevent the medicine containers 11 supplied onto the bottom surface of the outer container 37 from moving in the reverse direction via the guide surface 47 to flow to the exterior.

The climbing suppressing portion 49 is formed by a vertical surface formed at the lower edge portion of the guide surface 47. When the outer container 37 is caused to retreat relative to the ampoule extruding member 38, the climbing suppressing portion 49 comes into contact with the medicine containers 11 supplied onto the bottom surface of the outer container 37, thereby preventing them from climbing onto the guide surface 47. When a material such as rubber of large coefficient of friction is used for the vertical surface forming the climbing suppressing portion 49, it is advantageously possible to more effectively prevent the medicine containers 11 from climbing onto the guide surface.

As shown in FIG. 5, the shutter member 39 is a plate-like member provided on the support portion of the rotation plate 23 so as to be rotatable around a support shaft. A support shaft 39*a* includes a driven gear 51, and power is transmitted from a driving gear 53 provided on the rotation shaft of a motor (not shown) via an intermediate gear 52. As a result, the shutter member 39 rotates between a closing position where it closes a front opening of the outer container 37 situated at the waiting position, and a retaining position where it is placed on the rotation plate 23 in the horizontal position and presses the lower inner surface of the bag 13, whose opening is open.

Figure 3:
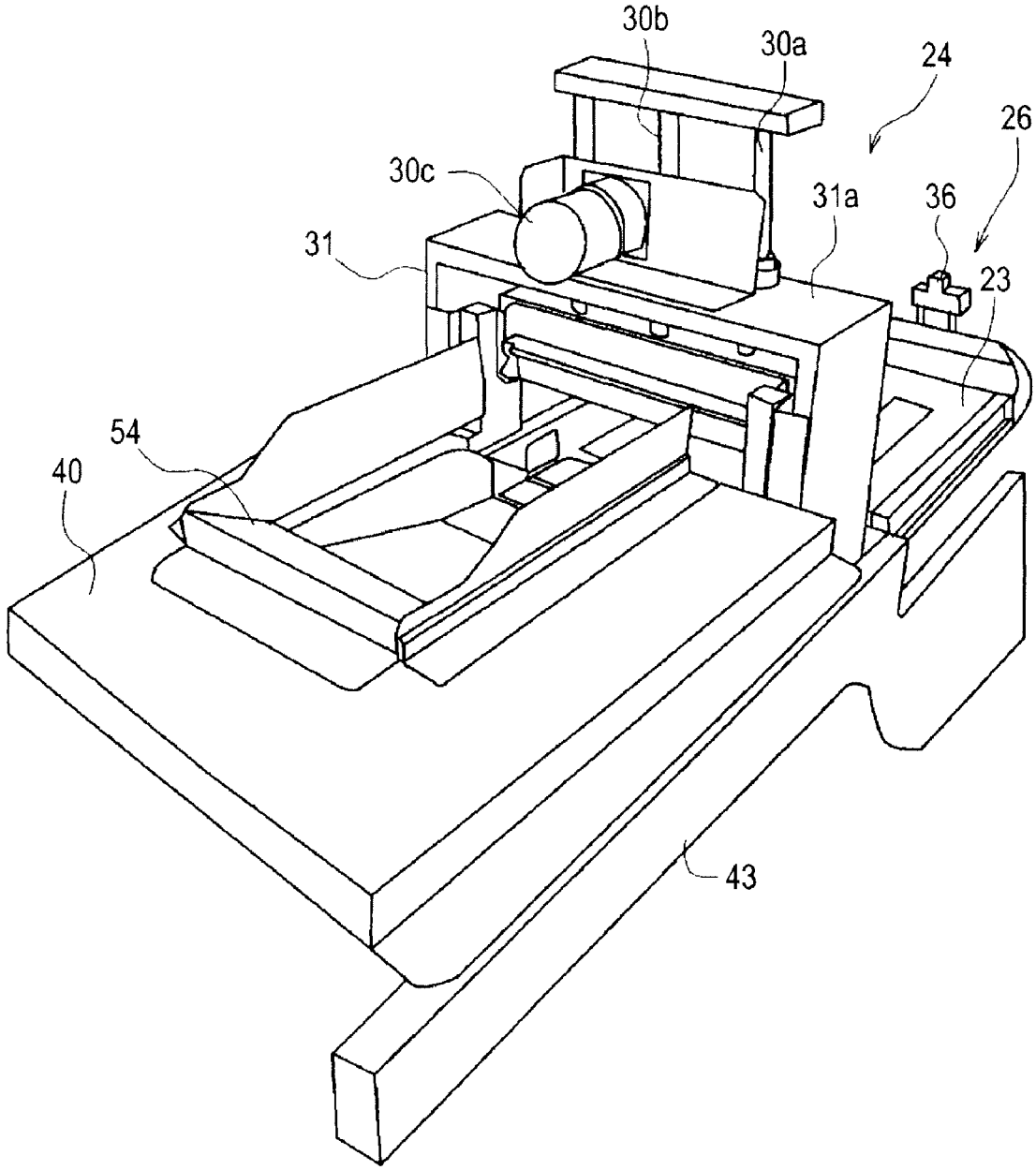
FIG. 3 illustrates a perspective view of a medicine container supply portion of the machine of FIG. 1.

As shown in FIG. 3, the cover member 40 is provided on the frame 43 of the machine main body 1 so as to cover the entire upper surface of the medicine container supply portion 5, and includes a charging port 54 to make it possible to supply the medicine containers 11 from the tray 50 to the medicine container storage region. The charging port 54 is opened when the outer container 37 and the ampoule extruding member 38 are situated at the waiting position, making it possible to supply the medicine containers 11 to the medicine container storage region via the guide surface 47 of the ampoule extruding member 38. When the outer container 37 and the ampoule extruding member 38 advance toward the supply position, the charging of medicine containers 11 into the charging port 54 becomes impossible.

(Medicine Container Charging Portion) As shown in FIG. 1, the medicine container charging portion 6 includes a lifter 55 and a swinging arm 56.

The lifter 55 causes a support stand 55*b* to ascend and descend through driving a belt 55*a* arranged to extend in the vertical direction. The swinging arm 56 rotates the tray 50 conveyed to the upper position by the lifter 55 to place it in an inclined state, thereby charging the accommodated medicine containers 11 into the medicine container supply portion 5 (charging port 54).

The tray 50 is formed such that the end portion thereof, which is situated on the lower side when it is rotated by the swinging arm 56, is gradually reduced in width and depth toward the forward end. As a result, when the tray 50 is inclined by the swinging arm 56, the medicine containers 11 accommodated in the tray 50 are gathered and charged smoothly into the charging port 54.

The bag printing portion 2, the bag conveying portion 3, the bag positioning portion 4, the medicine container supply portion 5, and the medicine container charging portion 6 are drive-controlled by a control device 59 based on input data from a host computer 12.

The supply of the medicine containers 11 to the tray 50 is effected by a conventionally well-known medicine container supply device. Here, the medicine containers 11 include objects such as ampoules or vials, which are subject to damage by impact.

(Operation) Next, the operation of the machine for filling a bag with medicine containers, constructed as described above, is illustrated.

(Medicine Container Supply) When receiving prescription data from the host computer 12, a medicine container supply device (not shown) supplies the corresponding medicine containers 11 into the tray 50 based on the prescription data. Then, the tray 50 to which the medicine containers 11 has been supplied is conveyed to the medicine container charging portion 6.

In the medicine container charging portion 6, the control device 59 drive-controls the motor 41*d* (FIG. 5) based on an input signal from the host computer 12, and moves the outer container 37 and the ampoule extruding member 38 to the waiting position, thereby closing the charging port 54 of the cover member 40. In this state, the guide surface 47 of the ampoule extruding member 38 is continuous with the charging port 54, and the medicine containers 11 charged from the tray 50 can be smoothly guided to the medicine container storage region. Further, the shutter member 39 is rotated to the closing position so that the medicine containers 11 supplied to the medicine container storage region may not be spilled.

Then, the lifter 55 (see FIG. 1) is driven to move the tray 50 to the upper position, and the swinging arm 56 is swung, whereby the medicine containers 11 in the tray 50 are supplied to the medicine container storage region via the charging port 54. The medicine containers 11 roll or slide on the guide surface 47 until they reach the bottom surface of the outer container (see FIG. 11(*a*)). The guide surface 47 exhibits a small coefficient of friction, and helps to supply the medicine containers 11, in particular, medicine containers 11 subject to damage, such as ampoules, to the bottom surface. Even when the medicine containers 11 are supplied with momentum via the guide surface 47, the bottom surface of the outer container 37 mitigates the impact.

(Supply of the Bag) In parallel with the supply of the medicine containers 11, the bag 13 is supplied. That is, the control device 59 drives the bag printer 7 based on the prescription data received from the host computer 12, and effect corresponding printing on each label of the bag strip 9 from the bag roll 8. Then, the bag strip is cut by the cutter 10 to obtain the individual bags 13, which are supplied to a conveyor portion 22. In the conveyor portion 22, a belt 22*a* is driven, positioning the bag 13 at a predetermined position.

Then, the bag conveying portion 3 (horizontal moving member 14, vertical moving member 15, etc.) is drive-controlled, and the suction cylinders 21 of the suction member 16 are opposed to the four corners of the bag 13. Then, a suction device (not shown) is driven, and the bag 13 is suctioned by the suction cylinders 21, such that the suction member 16 retains the bag 13. Subsequently, the conveying portion 3 is drive-controlled, and the bag 13 is conveyed to the rotation plate 23 (see FIG. 11(*a*)). The placing position on the rotation plate 23 is specified based on previously registered coordinate data.

(Charging of Medicine Containers into the Bag) Both sides of the opening of the bag 13 supplied onto the rotation plate 23 are suctioned via the suction holes 23*a* and 30*f*. By upwardly moving the ascent/descent member 30, the bag 13 is opened to allow charging with the medicine containers 11. As shown in FIGS. 7(*a*)-7(*b*) and 8(*a*)-8(*b*), at this time, the presser member 32 rotates, and the upper inner surface of the opening portion of the bag 13 is pressed. Further, the shutter member 39 is rotated to press the lower inner surface of the opening portion of the bag 13 (see FIG. 11(*b*)).

Figure 9:
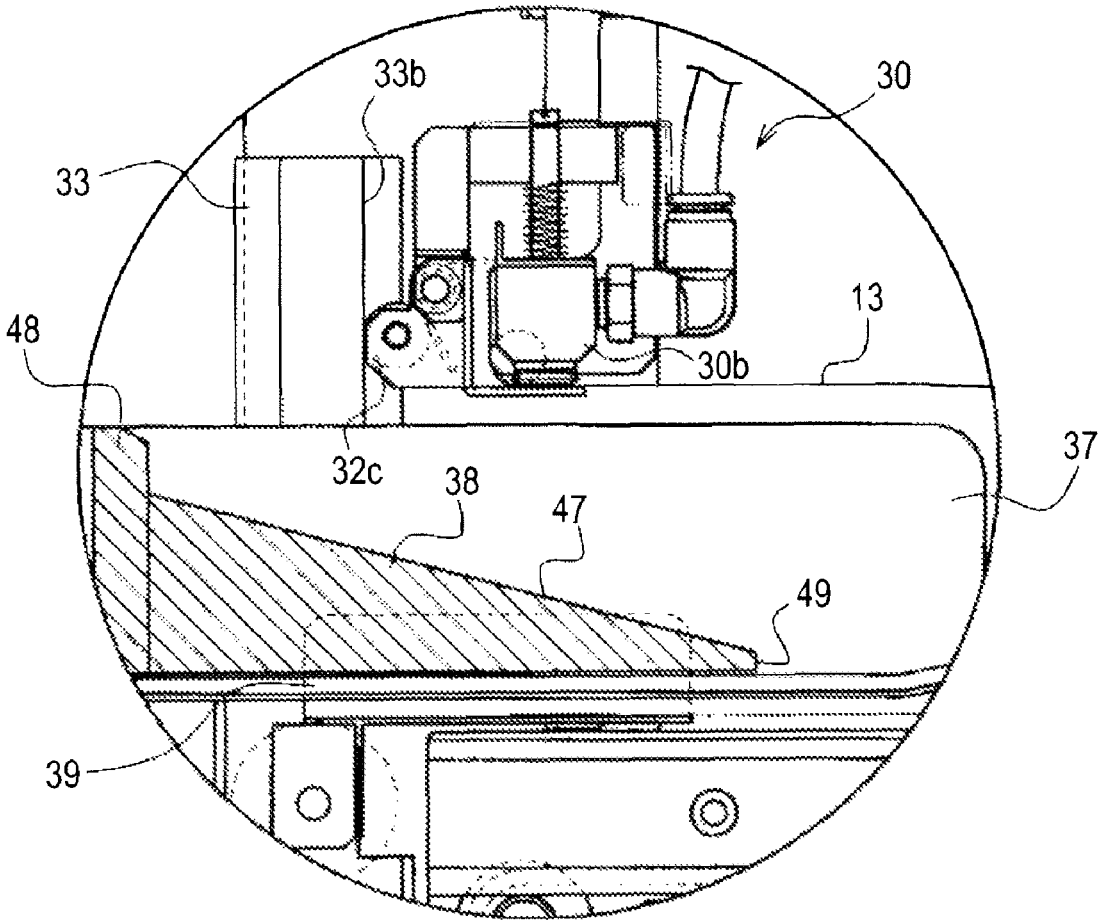
FIG. 9 illustrates a front view showing in detail the region including the ascent/descent member.
Figure 10:
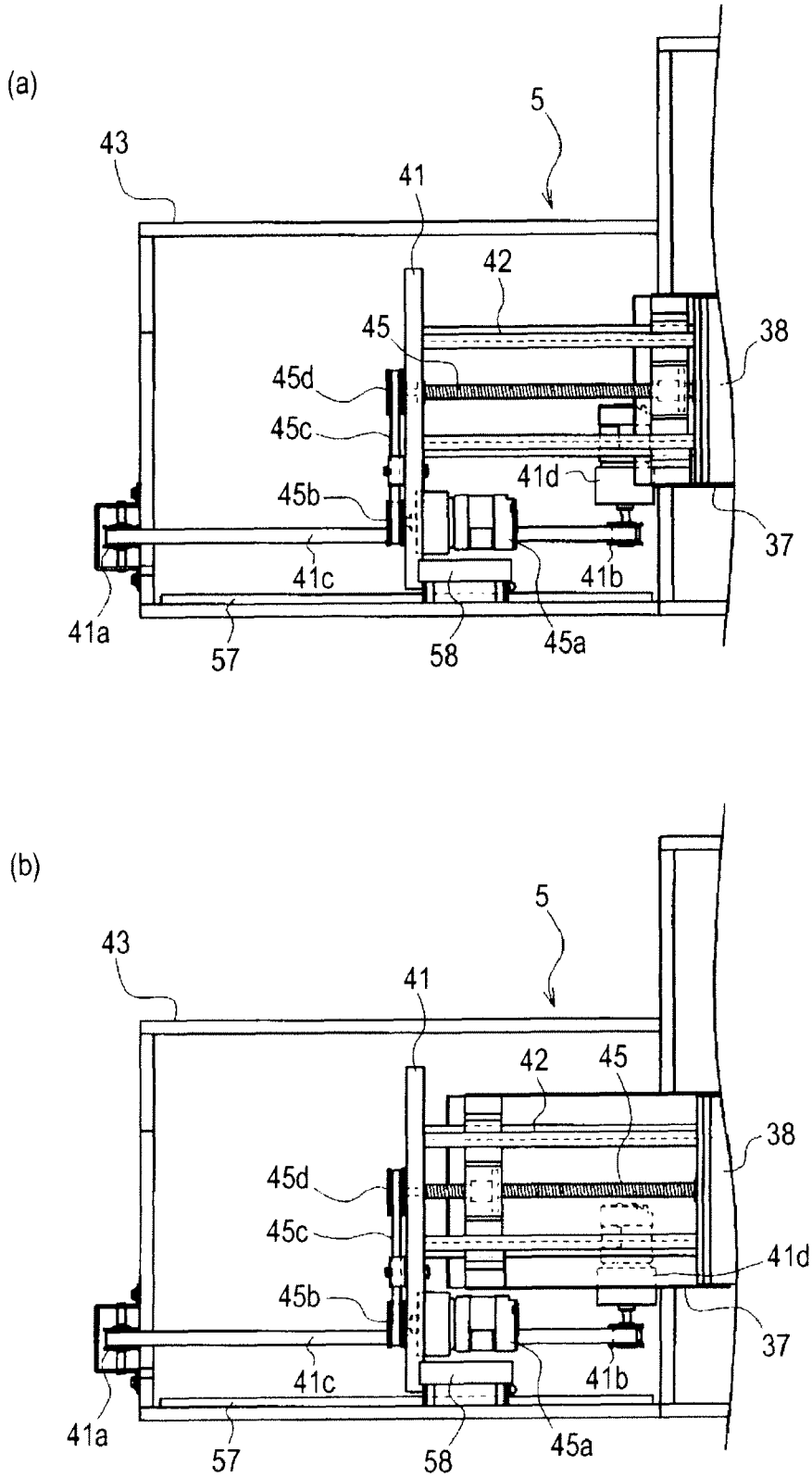
FIG. 10(*a*) is a plan view showing a state in which the outer container and the ampoule extruding member are moved to the supply position from the position of FIG. 6.

Next, the motor 46*d* is driven to cause the outer container 37 and the ampoule extruding member 38 to enter the bag 13 before stopping at the supply position (see FIGS. 9, 10(*a*), and 11(*c*)). Since it is possible to reliably open the opening of the bag 13 in a predetermined size by the shutter member 39 and the presser member 32, it is possible to allow the outer container 37 and the ampoule extruding member 38 to smoothly enter the bag 13. Since the forward end portion of the side wall of the outer container 37 is formed in an arcuate configuration, there is no fear of the bag 13 being damaged.

At the supply position, the medicine container storage region is situated completely within the bag 13. Then, the motor 45*a* is driven to retract solely the outer container 37 from the bag 13 (see FIGS. 10(*b*) and 11(*d*)). As a result, the medicine containers 11 in the medicine container storage region cease to be supported by the bottom surface of the outer container 37, and are forcibly caused to remain in the bag 13 by the ampoule extruding member 38, more specifically, by the climbing suppressing portion 49 and the guide surface 47. In this case, the medicine containers 11 simply undergo regulation in position by the ampoule extruding member 38, so their position in the bag 13 is scarcely changed. Thus, there occurs substantially no problem of medicine container damage due to collision of medicine containers with each other. Even when the medicine containers 11 slide on the guide surface 47 to move to the upper side, they are prevented from flowing out by the detachment preventing portion 48. Further, the inner surface of the bag 13 is situated in the vicinity of the upper side of the detachment preventing portion, and hence the medicine containers 11 do not flow out of the bag 13.

Figure 11:
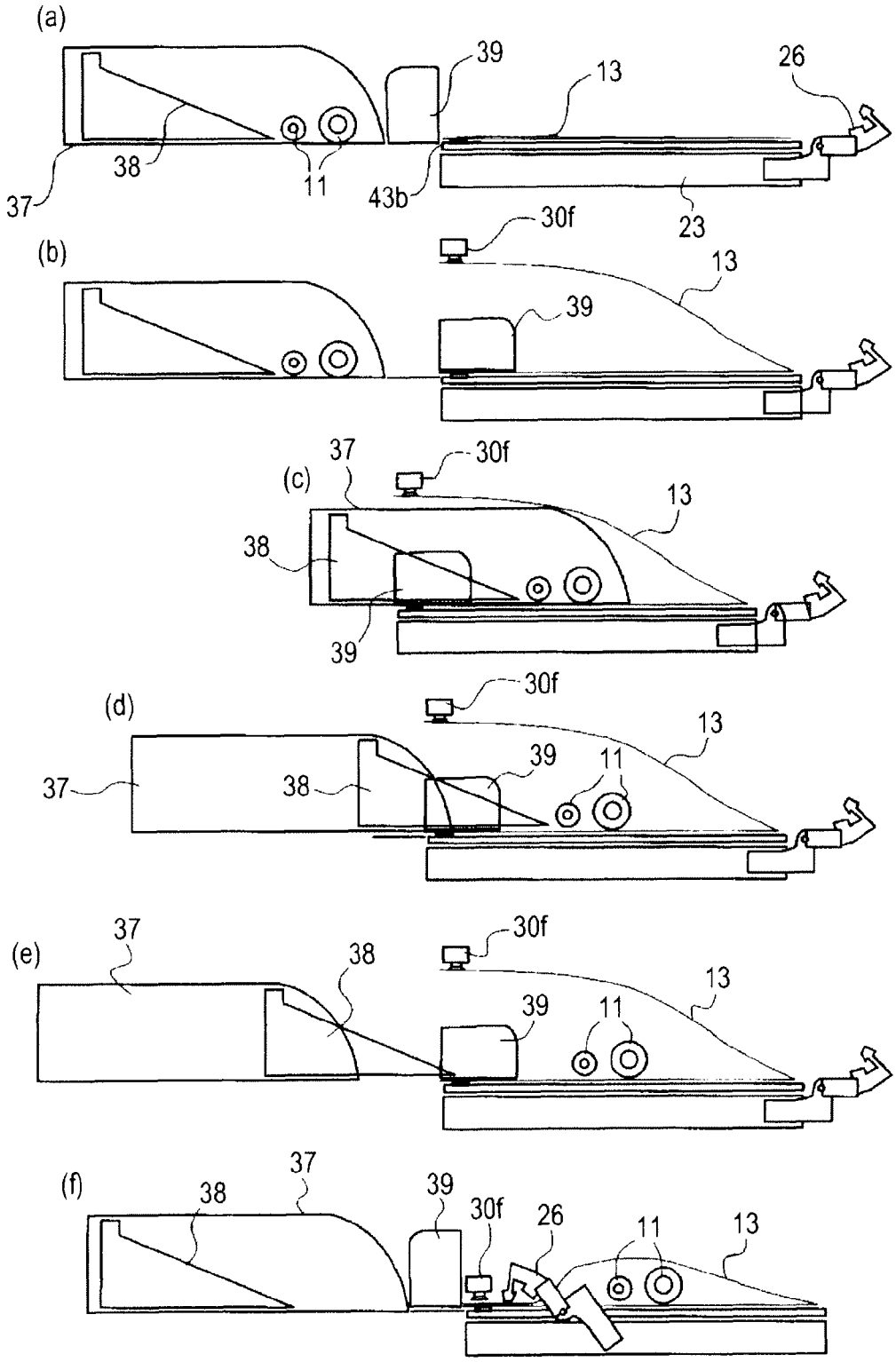
FIGS. 11(*a*)-11(*f*) are schematic explanatory views illustrating steps in the supply of medicine containers into a bag.
Figure 12:
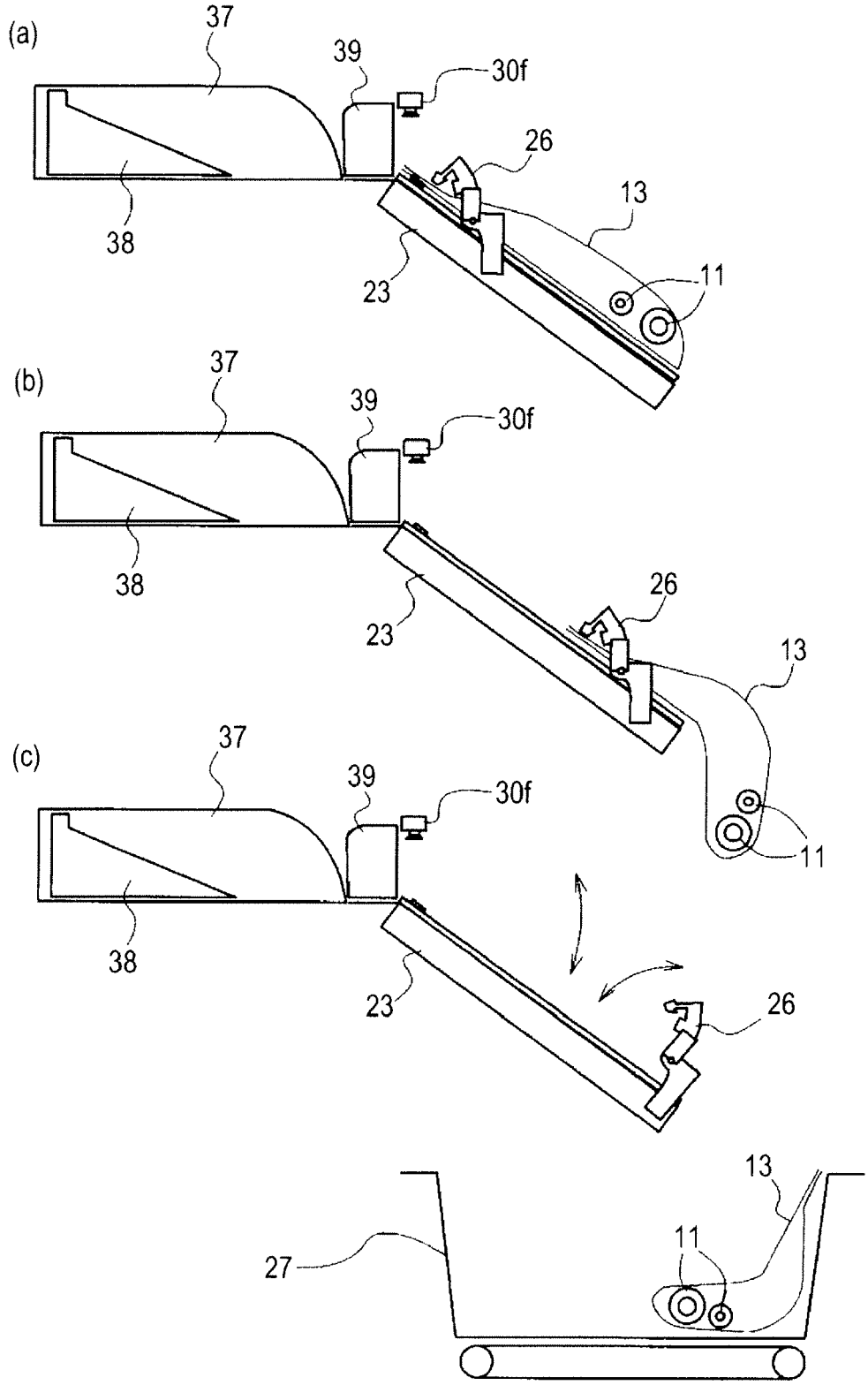
FIGS. 12(*a*)-12(*d*) are schematic explanatory views illustrating steps in the supply of medicine containers into a bag.

When the supply of the medicine containers 11 into the bag 13 is completed, the motor is driven to move both the outer container 37 and the ampoule extruding member 38 out of the bag 13 (see FIG. 11(*e*)). Further, the ascent/descent member 30 is lowered, and the positioning of the bag 13 by the shutter member 39 and the presser member 32 is canceled. As a result, the opening portion of the bag 13 is held between the support portion and the ascent/descent member 30. Here, electricity is supplied to the heating portion 25*a* to effect temporary sealing through heat sealing at four positions of the opening portion of the bag 13. Further, the bag retaining arm 26 is caused to slide along the rotation plate 23, and is rotated to bring the pressing portion 36 into press contact with the portion in the vicinity of the opening (both side portions) of the bag 13 (see FIG. 11(*f*)). The elongated holes 29 are situated on the side of the bag 13 opposite to the side where it is held in press contact with the pressing portion 36. Thus, it is possible to effectively apply solely the frictional force of the pressing portion 36 to the bag 13. Then, the rotation plate 23 is rotated to the inclined position (see FIG. 12(*a*)). Then, the bag retaining arm 26 is moved (see FIG. 12(*b*)). Finally, the bag retaining arm 26 is rotated to the former position, whereby the retaining state of the bag 13 is canceled, and the bag 13 is supplied into the bucket 27 (see FIG. 12(*c*)). In this way, the bag 13 whose opening has already been temporarily sealed can be smoothly conveyed to the bucket 27 supplied to the predetermined position.

As described above, in the machine for filling a bag with medicine containers according to the above embodiment, solely inclining the tray 50, the medicine containers 11 in the tray 50 can be charged into the medicine container storage region in the outer container 37 via the charging port 54. In this case, the medicine containers 11 can be smoothly guided to the medicine container storage region by the guide surface 47 continuous with the inclined tray 50. Further, after moving both the outer container 37 and the ampoule extruding member 38 to the bag 13, solely the outer container 37 is retracted, whereby the medicine containers 11 in the medicine container storage region remain in the bag 13. Thus, it is possible to cause medicine containers 11 to remain in the bag 13 after moving them into the bag 13, while maintaining the positional relationship between medicine containers. Thus, even if the operation of filling the bag 13 with the medicine containers 11 is conducted at high speed, there is no fear of the medicine containers suffering damage from colliding with each other.

Figure 13:
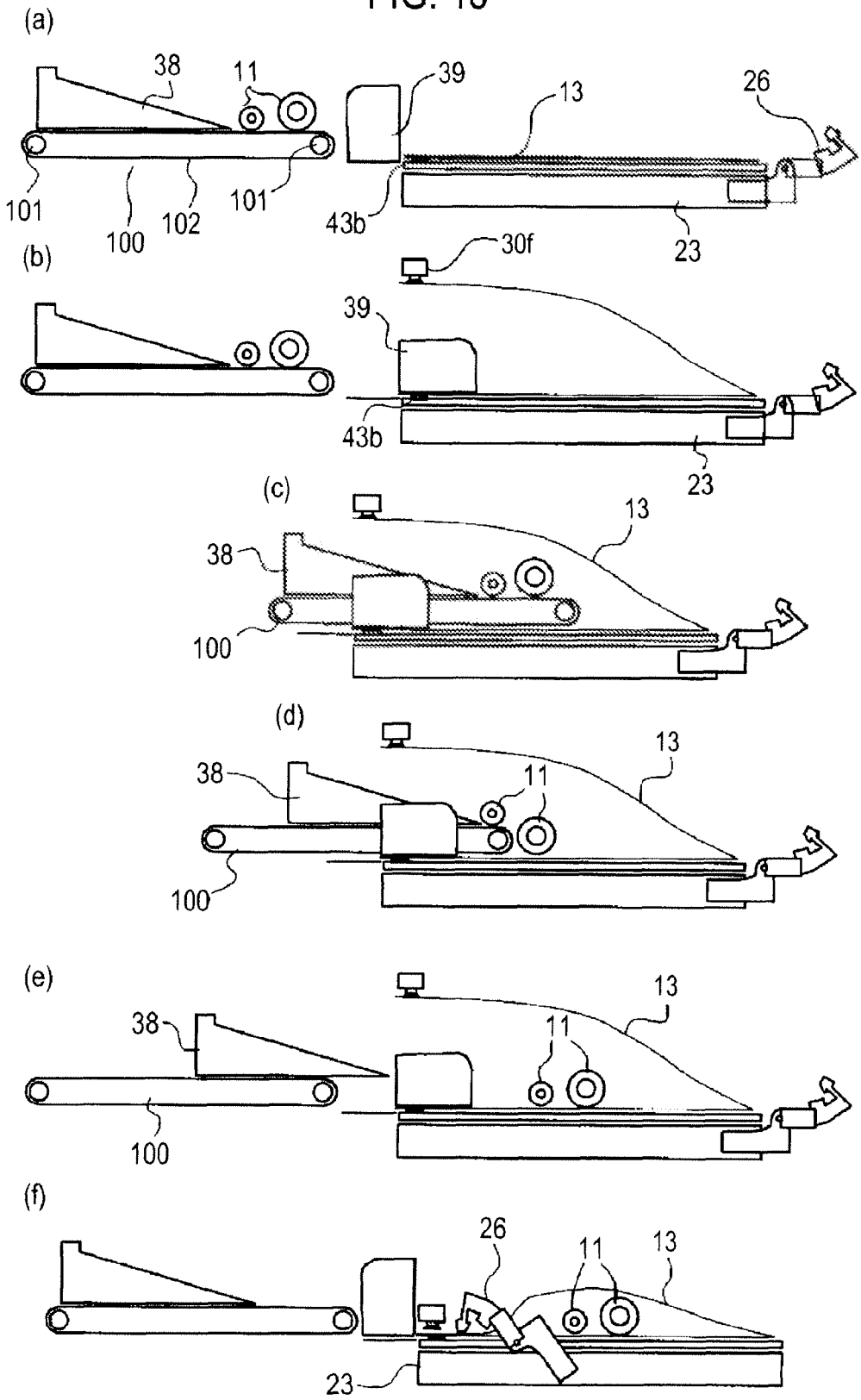
FIGS. 13(*a*)-13(*f*) are schematic explanatory views illustrating steps in the supply of medicine containers into a bag according to another embodiment.

(Other Embodiment) While in the above-mentioned embodiment the first moving member is formed by the outer container 37, it may also be formed by a belt conveyor 100 as shown in FIGS. 13(*a*)-13(*f*). The belt conveyor 100 has a simple construction in which a belt 102 is stretched between a pair of rotatable pulleys 101 arranged at a predetermined interval.

With this construction, in the state shown in FIG. 13(*a*), the bag 13 is opened by the suction holes 43*b* and 30*f* as in the above-mentioned embodiment, and the open state is reliably attained by the shutter member 39 (see FIG. 13(*b*)). Then, both the belt conveyor 100 and the ampoule extruding member 38 are moved into the bag 13 (see FIG. 13(*c*)), and solely the belt conveyor 100 is retracted out of the bag 13, whereby the medicine containers 11 placed on the belt conveyor 100 are pushed back into the bag 13 by the ampoule extruding member 38 (see FIG. 13(*d*)). The belt 102 of the belt conveyor 100 is simply stretched between the rotatable pulleys 101. Thus, by being pushed by the ampoule extruding member 38, the medicine containers 11 cause the belt 102 to move. Thus, no excessive load is applied to the medicine containers 11, which are allowed to smoothly remain in the bag 13. After that, as in the above-mentioned embodiment, the belt conveyor 100 and the ampoule extruding member 38 are retracted out of the bag 13 (see FIG. 13(*e*)), and the opening of the bag 13 is temporarily sealed shut by the bag retaining arm 26 (see FIG. 13(*f*)) before the bag 13 is transferred to the bucket 27.

Figure 14:
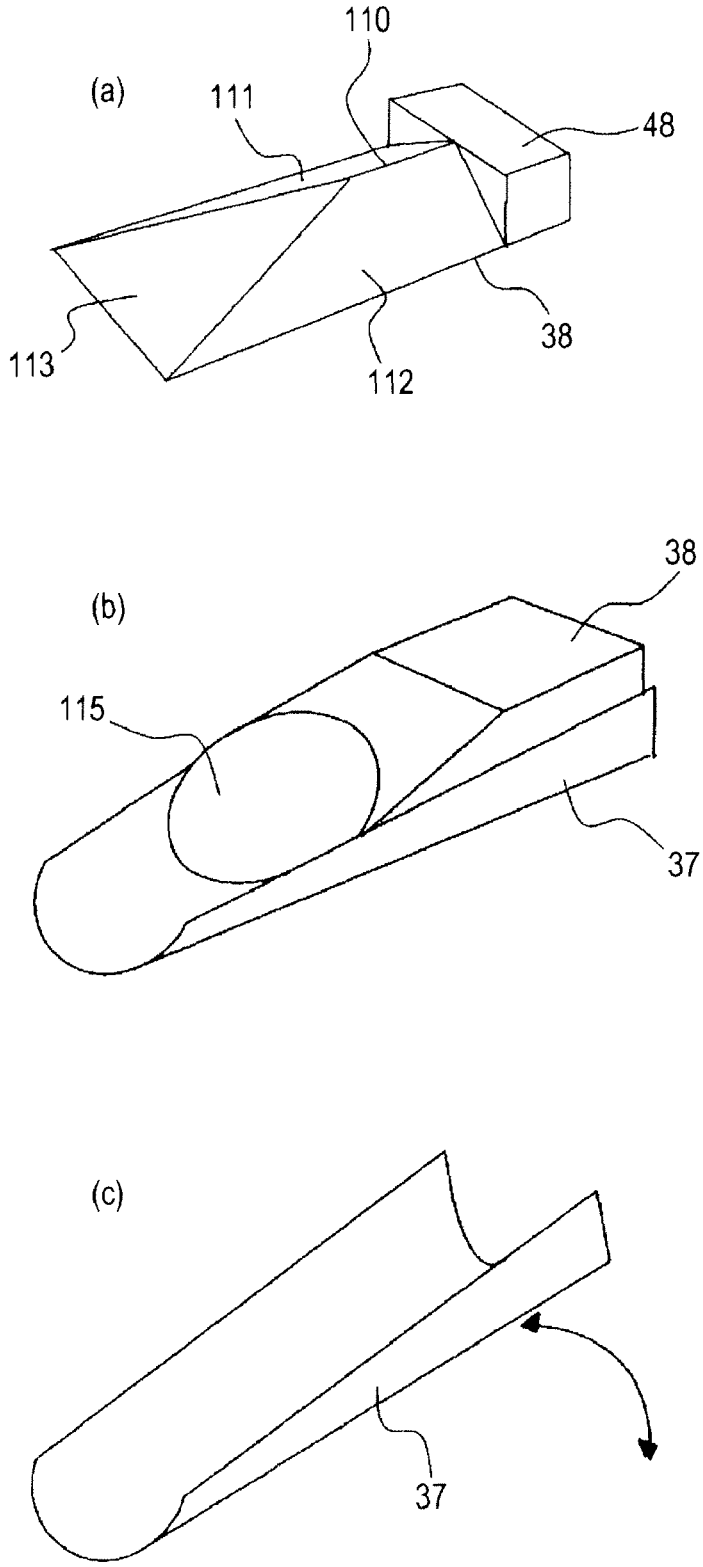
FIGS. 14(*a*)-14(*c*) are perspective views of an example of a first moving member and a second moving member of a machine for filling a bag with medicine containers according to another embodiment.

(Other Embodiment) While in the above-mentioned embodiment the second moving member includes the ampoule extruding member 38 as shown in FIGS. 5, 6, etc., it is also possible to adopt a form as shown in FIGS. 14(*a*)-14(*c*).

In FIG. 14(*a*), the guide surface 47 (including the climbing suppressing portion 49) of the ampoule extruding member 38 includes a first inclined surface 111 and a second inclined surface 112, which are gradually inclined downwards toward both sides from a ridge 110, and a third inclined surface 113 which is inclined gradually downwards from the central portion toward the forward end. With this construction, the charged medicine containers 11 are aligned in the charging direction by the first and second inclined surfaces 111 and 112. Thus, if solely the outer container 37 is retracted out of the bag 13 (operation corresponding to FIG. 10(*b*) and FIG. 11(*d*)), the medicine containers 11 aligned in the charging direction do not easily move toward the ampoule extruding member 38 side. Further, the medicine containers 11 (mainly ampoules) that tend to move on the third inclined surface 113 are divided into both sides by the ridge 110, and respectively move (roll or slide) on the first inclined surface 111 and the second inclined surface 112, or move as they are on the third inclined surface 113 to remain in the bag 13. In this way, the medicine containers 11 are caused to remain in the bag 13 in a dispersed state, and hence it is possible to adequately prevent a problem such as medicine containers being damaged from colliding with each other. While the example of FIG. 14(*a*) is formed by three inclined surfaces, it is also possible to form it by two or four or more inclined surfaces. In brief, any construction will suffice that helps to disperse the medicine containers 11 tending to climb onto the inclined surfaces because of retreat of the outer container 37, thereby allowing the medicine containers 11 to remain in the bag 13.

In the example shown in FIG. 14(*b*), the outer container 37 is formed so as to have a semi-arc-like sectional configuration and as to be gradually reduced in radius of curvature toward the forward end, and the ampoule extruding member 38 is accordingly formed such that its bottom surface swells in an arcuate fashion, with an elliptical inclined surface 115 being provided at the forward end. In this construction, due to the semi-arc-like sectional configuration of the outer container 37, the supplied medicine containers 11 (mainly ampoules) are aligned in orientation along the longitudinal direction. Thus, when solely the outer container 37 is retracted from the bag 13, the medicine containers 11 do not climb onto the inclined surface 115 of the ampoule extruding member 38, and are reliably allowed to remain in the bag 13.

In FIG. 14(*c*), instead of the construction having the outer container 37 and the ampoule extruding member 38 shown in FIG. 14(*b*), there is adopted a construction having solely the outer container 37, which is vertically (between the horizontal position and the inclined position) rotatable around the forward end as indicated by the arrows. In the horizontal position, the outer container 37 moves into the bag 13, with the medicine containers 11 placed thereon, then it is rotated to the inclined position, where the medicine containers 11 placed thereon are forcibly charged into the bag 13, and thereafter, it moves out of the bag (it may be temporarily restored to the horizontal position).

Figure 15:
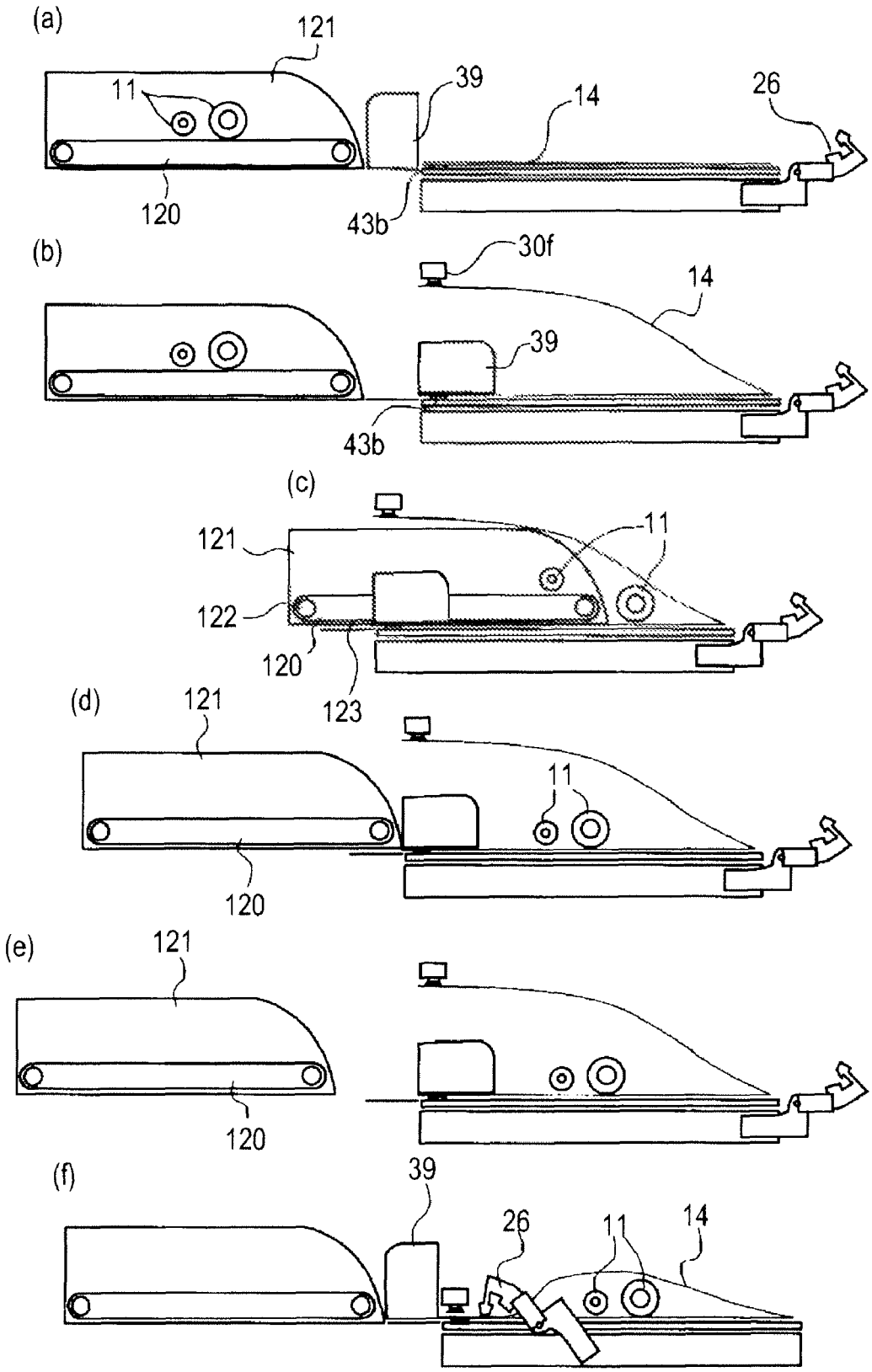
FIGS. 15(*a*)-15(*f*) are schematic explanatory views illustrating steps in the supply of medicine containers into a bag according to another embodiment.

(Other Embodiment) FIGS. 15(*a*)-15(*f*) are schematic front views of a machine for filling a bag with medicine containers according to another embodiment. This machine for filling a bag, instead of including the first and second moving members, includes a belt conveyor 120 and guide walls 121 on both sides thereof. In the belt conveyor 120, a belt 123 is stretched between a pair of pulleys 122, and one pulley 122 is capable of normal and reverse rotation through driving of a motor (not shown). The medicine containers 11 are directly charged from the medicine container charging portion 6 and are placed on the belt conveyor 120.

With the above-mentioned construction, the medicine containers are charged onto the belt conveyor 120 from the medicine container charging portion 6 (see FIG. 15(*a*)), and the bag 13 is opened by the suction holes 43*b* and 30*f* as in the above-mentioned embodiment (see FIG. 15(*b*)). Then, after the belt conveyor 120 is moved into the bag 13, the belt conveyor 120 is driven, and the medicine containers 11 placed thereon are forcibly supplied into the bag 13 (see FIG. 15(*c*)). In this case, the configuration and size of the medicine containers are stored in a storage means (e.g., a hard disk) (not shown), and the belt conveyor 120 is gradually retracted out of the bag 13 so that the medicine containers 11 may be properly accommodated in the bag 13 based on the data and the number of medicine containers to be accommodated in the bag 13. From this onward, the same processes (see FIGS. 15(*d*) through 15(*f*)) as those of the above embodiment are conducted.

While in the above embodiments both the outer container 37 and the ampoule extruding member 38 are moved into the bag 13, it is also possible to adopt a construction in which the bag 13 is moved toward the outer container 37 and the ampoule extruding member 38.

The invention claimed is:

1. A machine for filling a bag with medicine containers, the medicine containers including an ampoule or a vial, the machine including:

a bag positioning member for positioning and opening a bag;

a first moving member that reciprocates between a supply position inside the bag and a waiting position outside the bag, the first moving member including a bottom surface portion for supporting medicine containers;

a second moving member that is accommodated in the first moving member and that reciprocates relative to the bag and the first moving member, the second moving member including a guide surface for guiding medicine containers to the bottom surface portion; and a drive-control means that moves the first moving member and the second moving member between the supply position and the waiting position, wherein the bag positioning member includes a rotation plate rotatable between a horizontal position and an inclined position, a bag opening portion, a bag temporary sealing portion and a bag retaining arm, the rotation plate having guide grooves at both sides thereof and a support portion, the bag opening portion including a suction port for suctioning and retaining an outer side of an opening of the bag, the bag temporary sealing portion being provided on the support portion of the rotation plate and configured to temporarily seal the opening of the bag so that the medicine containers in the bag remain inside the bag, and the bag retaining arm being movable along the guide grooves of the rotation plate, wherein the drive-control means moves the first moving member and the second moving member from the waiting position to the supply position and then retracts only the first moving member out of the bag to prevent movement of the medicine containers by the guide surface of the second moving member, thereby causing the medicine containers to remain in the bag, and wherein the bag temporary sealing portion includes a plurality of heat-sealing portions that temporarily heat-seal the opening of the bag at a plurality of positions arranged at predetermined intervals along a width direction of the opening.

2. A machine for filling a bag with medicine containers according to claim 1, further comprising a shutter member that is positionable at an outflow preventing position to prevent outflow of medicine containers placed on the bottom surface portion of the first moving member, and is further positionable at a medicine container supply position where supply of medicine containers to the bottom surface portion is allowed and where an opening portion inner edge of the bag is pressed.

3. A machine for filling a bag with medicine containers according to claim 1 or 2, wherein the second moving member includes a detachment preventing portion that prevents medicine containers from flowing out from the guide surface to an exterior of the bag when the drive-control means moves the first moving member from the supply position to the waiting position.

4. A machine for filling a bag with medicine containers according to claim 1, wherein the second moving member includes a climbing suppressing portion that comes into contact with medicine containers to suppress climbing of medicine containers onto the guide surface when the drive-control means moves the first moving member from the supply position to the waiting position.

5. A machine for filling a bag with medicine containers according to claim 1, further comprising a cover member that covers an upper portion of a medicine container supply region formed by the first moving member and the second moving member, wherein the cover member includes a medicine container charging port that allows supply of medicine containers onto the bottom surface portion via the guide surface when the first moving member is in the waiting position, and that prevents medicine containers from being guided onto the bottom surface portion and prevents medicine containers from escaping from the bag when the second moving member is in the supply position.

6. A machine for filling a bag with medicine containers according to claim 2, wherein the second moving member includes a climbing suppressing portion that comes into contact with medicine containers to suppress climbing of medicine containers onto the guide surface when the drive-control means moves the first moving member from the supply position to the waiting position.

7. A machine for filling a bag with medicine containers according to claim 3, wherein the second moving member includes a climbing suppressing portion that comes into contact with medicine containers to suppress climbing of medicine containers onto the guide surface when the drive-control means moves the first moving member from the supply position to the waiting position.

8. A machine for filling a bag with medicine containers according to claim 1, further comprising a cover member that covers an upper portion of a medicine container supply region formed by the first moving member and the second moving member, wherein the cover member includes a medicine container charging port, that allows supply of medicine containers onto the bottom surface portion via the guide surface when the first moving member is in the waiting position, and that prevents medicine containers from being guided onto the bottom surface portion and prevents medicine containers from escaping from the bag when the first moving member is in the supply position.

9. A machine for filling a bag with medicine containers according to claim 2, further comprising a cover member that covers an upper portion of a medicine container supply region formed by the first moving member and the second moving member, wherein the cover member includes a medicine container charging port, that allows supply of medicine containers onto the bottom surface portion via the guide surface when the first moving member is in the waiting position, and that prevents medicine containers from being guided onto the bottom surface portion and prevents medicine containers from escaping from the bag when the first moving member is in the supply position.

10. A machine for filling a bag with medicine containers according to claim 3, further comprising a cover member that covers an upper portion of a medicine container supply region formed by the first moving member and the second moving member, wherein the cover member includes a medicine container charging port that allows supply of medicine containers onto the bottom surface portion via the guide surface when the first moving member is in the waiting position, and that prevents medicine containers from of being guided onto the bottom surface portion and prevents medicine containers from escaping from the bag when the first moving member is in the supply position.

11. A machine for filling a bag with medicine containers according to claim 4, further comprising a cover member that covers an upper portion of a medicine container supply region foiined by the first moving member and the second moving member, wherein the cover member includes a medicine container charging port that allows supply of medicine containers onto the bottom surface portion via the guide surface when the first moving member is in the waiting position, and that prevents medicine containers from being guided onto the bottom surface portion and prevents medicine containers from escaping from the bag when the first moving member is in the supply position.

12. A machine for filling a bag with medicine containers, the medicine containers including an ampoule or a vial, the machine comprising:

a bag positioning member for positioning and opening a bag;

a belt conveyor comprising a belt stretched between a pair of rotatable pulleys, the belt conveyor reciprocating between a supply position inside the bag and a waiting position outside the bag;

a medicine container charging member for supplying medicine containers onto the belt conveyor;

a guide member reciprocating relative to the bag and the belt conveyor, the guide member including a guide surface for guiding medicine containers supplied by the medicine container charging member onto the belt conveyor; and a drive-control means that horizontally moves the belt conveyor to the waiting position, drives the medicine container charging member to supply medicine containers onto the belt conveyor via the guide member, and after moving the belt conveyor and the guide member to the supply position, retracts only the belt conveyor out of the bag to prevent movement of medicine containers by the guide surface of the guide member, thereby causing medicine containers to remain in the bag, wherein the bag positioning member includes a rotation plate rotatable between a horizontal position and an inclined position, a bag opening portion, a bag temporary sealing portion and a bag retaining arm, the rotation plate having guide grooves at both sides thereof and a support portion, the bag opening portion including a suction port for suctioning and retaining an outer side of an opening of the bag, the bag temporary sealing portion being provided on the support portion of the rotation plate and temporarily sealing the opening of the bag so that the medicine containers in the bag remain within the bag, and the bag retaining arm being movable along the guide grooves of the rotation plate, and wherein the bag temporary sealing portion includes a plurality of heat-sealing portions that temporarily heat-seal the opening of the bag at a plurality of positions arranged at predetermined intervals along a width direction of the opening.

* * * * *